US006955616B1

(12) United States Patent
Barth et al.

(10) Patent No.: US 6,955,616 B1
(45) Date of Patent: Oct. 18, 2005

(54) BASEBALL BATTING STRIDE DEVICE AND SYSTEM, AND METHOD OF USING SAME

(76) Inventors: Gary A Barth, 119 Pinewood, Hot Springs, AR (US) 71913; Greg A. Barth, 163 Wedgewood Terrace Rd., Madison, AL (US) 35757

( * ) Notice: Subject to any disclaimer, the term of this patent is extended or adjusted under 35 U.S.C. 154(b) by 44 days.

(21) Appl. No.: 10/695,389

(22) Filed: Oct. 28, 2003

Related U.S. Application Data

(63) Continuation of application No. 10/040,126, filed on Jan. 4, 2002, now abandoned.

(51) Int. Cl.[7] ..... A63B 69/00; A63B 57/00; A63B 23/08

(52) U.S. Cl. ..... 473/452; 473/217; 482/79

(58) Field of Search ..... 473/150, 217, 473/452, 458, 464, 450; 482/79, 130, 145; 36/11.5; 280/619, 28.16, 600, 605, 14.2, 280/22.1; 441/70

(56) References Cited

U.S. PATENT DOCUMENTS

| | | | | | |
|---|---|---|---|---|---|
| 1,476,905 | A | * | 12/1923 | Mardus | 441/76 |
| 4,268,033 | A | * | 5/1981 | Fontaine | 473/2 |
| 4,688,796 | A | * | 8/1987 | Wright | 473/2 |
| 4,915,400 | A | * | 4/1990 | Chambers | 280/14.27 |
| 5,147,234 | A | * | 9/1992 | Brug | 441/70 |
| 5,275,398 | A | * | 1/1994 | Compton | 473/2 |
| 5,554,075 | A | * | 9/1996 | Glazer | 473/2 |
| 5,938,492 | A | * | 8/1999 | Carlini | 441/75 |
| 6,132,319 | A | * | 10/2000 | Schluter | 473/2 |
| 6,155,929 | A | * | 12/2000 | Chipman | 473/2 |

FOREIGN PATENT DOCUMENTS

| | | | | |
|---|---|---|---|---|
| GB | 2184221 | A | * | 6/1987 ..... A63D 15/00 |

* cited by examiner

*Primary Examiner*—Mitra Aryanpour
(74) *Attorney, Agent, or Firm*—Joe D. Calhoun

(57) ABSTRACT

An apparatus for modifying the stride of a baseball batter's swing motion, including means of capturing a lower portion of a baseball batter's foot and means of elastomerically tethering the capturing means to substratum, wherein the batter's leading foot is allowed to stride in any direction essentially free of substantial distal destabilizing hindrance.

16 Claims, 2 Drawing Sheets

BASEBALL BATTING STRIDE DEVICE AND SYSTEM, AND METHOD OF USING SAME

CROSS REFERENCES TO RELATED APPLICATIONS

This application is a continuation application of U.S. application Ser. No. 10/040,126 filed 4 Jan. 2002, now abandoned, and this application claims the benefit of said application pursuant to 35 U.S.C. § 120.

FEDERALLY SPONSORED RESEARCH OR DEVELOPMENT

Not applicable.

MICROFICHE APPENDIX

Not applicable.

BACKGROUND OF THE INVENTION (1) Field of the Invention

The invention disclosed herein generally relates to devices and methods for training baseball players in the skill of batting. More specifically, this invention relates to devices for teaching a baseball player proper foot and lower body techniques for batting, including the optimal stride length, direction, and toe-orientation.

Although the sport of baseball has been in existence for many years, and is played by very young individuals as well as old, it is quite difficult to hit a baseball with a bat. Even the most accomplished professional fails to hit the ball well enough to put it into play more than one out of three times at bat. Current batting theory teaches the batter to stride forward, in a direction parallel to and toward the oncoming pitched ball. One prevailing philosophy holds that the batter should stride forward forcefully, to effect a weight shift from the back foot to the front foot toward the pitcher's mound. While striding, the batter should keep the leading front foot oriented perpendicularly to the path of the oncoming pitched baseball (outer ankle forward), so that the batter's toes do not point toward the pitching mound. Toe pivoting allowing the toes to point toward the pitching mound may cause the batter's knee and hip to improperly "open up" to face the oncoming ball, thereby unnecessarily altering the batter's skeletal and muscular alignment mid-swing when it is most critical to maintain coordinated swinging motion and leg strength.

The optimal length and direction of stride, and the optimal foot orientation, may differ for each individual depending upon his or her physical attributes and inclinations. Many batter's are naturally inclined to stride forward with the toes of the lead foot pointing directly at the pitcher's mound. The optimal batting stride and technique for each batter may require a uniquely different combination of biasing to obtain the desired stride length, direction, and toe-orientation. It may be difficult for some batters to maintain proper balance following the forward stride, if the batter's leading toes are not pointing at least diagonally toward the pitching mound. The toes are critical in maintaining balance, and any device for teaching batting techniques should not create substantial destabilizing impediments or hindrance during the stride forward.

There is therefore a need for a device capable of biasing the leading foot away from having the toes point directly at or toward the pitcher's mound, yet do so in such a manner that optimizes the stride length, direction and toe-orientation for that particular batter without erecting any substantial destabilizing hindrance.

(2) Description of the Related Art Including Information Disclosed under 37 C.F.R. 1.97 and 1.98

The following patents are arguably relevant to the patentability of the invention disclosed herein:

| U.S. Pat. No. | 1st Inventor | Date |
|---|---|---|
| 3,350,096 | Kile et al | Oct. 31, 1967 |
| 3,372,930 | Sertich | Mar. 12, 1968 |
| 3,466,040 | Sertich | Sep. 9, 1969 |
| 3,815,906 | Hermo | Jun. 11, 1974 |
| 4,194,735 | Wilson | Mar. 25, 1980 |
| 4,516,772 | Stratton | May 14, 1985 |
| 4,932,656 | Pierce | Jun. 12, 1990 |
| 5,318,290 | Sawyer | Jun. 7, 1994 |
| 5,613,677 | Walker, Jr. | Mar. 25, 1997 |

U.S. Pat. No. 3,350,096 issued to Kile et al discloses a guide for constraining the batter from stepping out of the batter's box, and to encourage the batter to stand toward the home plate. Kile discloses a guide for restricting movement of a batter's foot, to prevent the leading foot from stepping out of the batter's box. Kile claims a guide for restricting a batter's foot during batting practice, comprising a pair of parallel track means (wires) extending longitudinally beside the batter's box, with a foot stirrup resiliently attached between those track members. According to Kile, this device allows relatively free movement of the leading front foot forward during the batting stride, but normally constrains lateral movement of the foot. Kile uses track wires elevated slightly above the ground, posing some danger of the batter tripping over them, perhaps at a critical time such as when dodging an errant baseball pitch. Although Kile believes that there is little danger of the back foot tripping over the guide wires, Kile never discusses the prospects of the leading foot tripping over the guides wires. By contrast, the invention disclosed herein elastically tethers the foot without anything to trip over or otherwise prevent the batter's toes from maintaining balance. Kile also indicates that lateral movement of the foot is constrained, while forward movement is relatively free. By contrast, the present invention constrains movement essentially equally in all directions.

U.S. Pat. No. 4,516,772 issued to Stratton discloses an elongated raised guiding rail with a rider sliding thereon, including a paddle-like front foot guide restricting movement of the front foot as it strides forward during batting. The Stratton device suffers the same destabilization problems as the Kile device; the foot paddle and rail present obstacles to catch the batter's toes at an inopportune time, such as when it is crucial for the batter to dodge a pitch that is either errant or intentionally thrown across the inside corner of home plate.

BRIEF SUMMARY OF THE INVENTION

In very general terms, one version the invention is essentially an apparatus for modifying the stride of a baseball batter's swing motion, comprising means of capturing a lower portion of a baseball batter's front foot, and means of elastomerically tethering the capturing means to substratum. In this manner, the batter's leading toes are allowed to stride in any direction essentially free of substantial distal destabilizing hindrance.

One simple version is essentially one or two short bunge cords with terminal hooks, the ends of one cord being inserted through an aperture in a base plate such as carpet, so that the intermediate portion essentially forms an elastic loop or stirrup through which a front portion of the batter's foot is inserted. That stirrup assembly may be secured to the ground, to prevent movement when the batter attempts to raise his foot during a batting swing. The amount of permissible foot movement may be adjusted, depending upon the dimensions and characteristics of the elastic stirrup. Differing amounts of yoking may be achieved by varying the length, width, thickness and elasticity of the stirrup or tethering. The foot may additionally be secured within the stirrup by a second elastic cord, extending from one lateral subsegment of the stirrup rearward around the heel portion of the batter, and reconnecting at the opposite lateral subsegment of the stirrup.

A more preferred version replaces the bunge cords with nylon strapping. The tethering strap is elastomeric, and it may be detachable from the stirrup (which may not include elasticity). The tethering strap may also be detachable from the substratum.

DETAILED DESCRIPTION OF THE INVENTION

Figure 1:
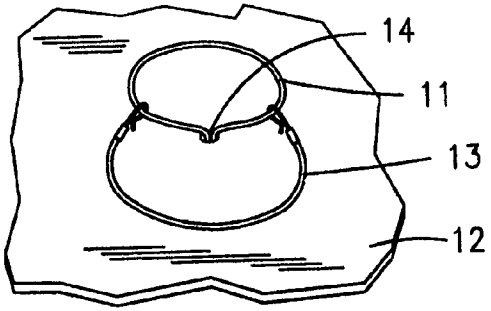
FIG. 1 is a perspective view from above and rear, looking down (at about 45°) at this version in an unused configuration; this drawing depicts the stirrup (11) looping up through an aperture (14) in the substratum (12), and with an optional heel stirrup (13).
Figure 2:
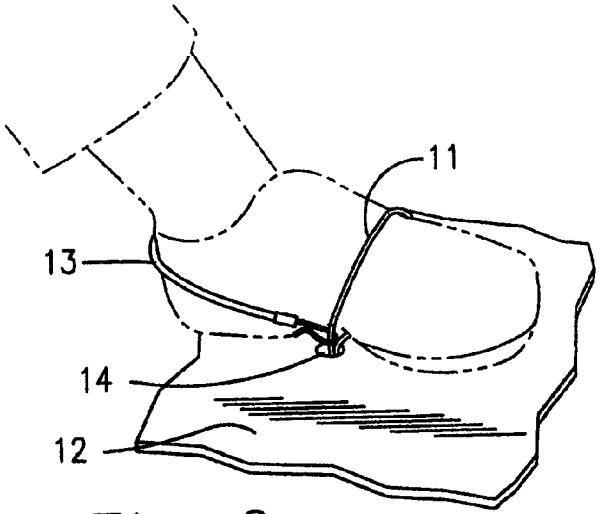
FIG. 2 is a perspective view from the side, looking down (at about 45°) at the invention of FIG. 1 in a used position encapturing a batter's front foot (broken lines, for illustrative purposes only, without forming any part of the claimed design): on the inner side of the batter's foot, the stirrup (11) is looping up through an aperture (14) in the substratum (12), and with an optional heel stirrup (13).
Figure 3:
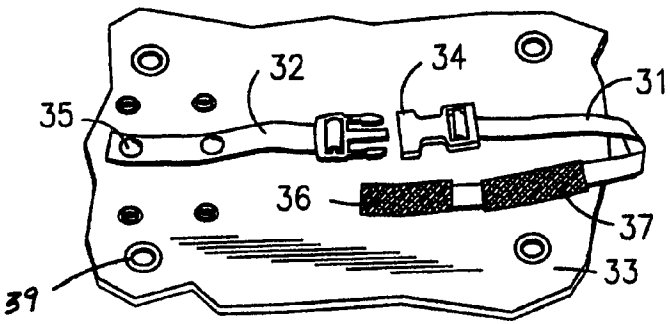
FIG. 3 is a perspective view from above and the side, looking down (at about 45°) at another version of the invention in an open (unbuckled) unused configuration; this drawing depicts a hook-and-loop stirrup (31) having one end attached to the quick-release buckle (first terminus, 34) and having its free end (second terminus) including a matable half of a hook-and-loop strip (36) and sized for threading through an aperture formed in the end of the buckle en route to doubling back against the other half of a hook-and-loop strip (37); the stirrup is thereby releasably attached to a tether (32) via an interlocking quick-release buckle, the tether being releasably anchored to the substratum (33) via at least one matable snap (35).
Figure 4:
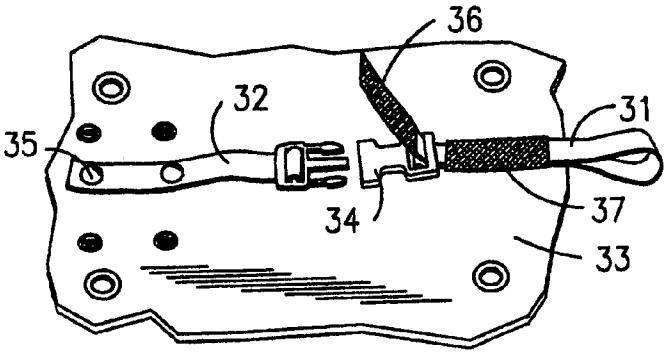
FIG. 4 is the same view as FIG. 3, depicting a matable half of a hook-and-loop strip (36) threaded through an aperture formed in the end of the buckle (34), ready for doubling back against the other matable half of a hook-and-loop strip (37).
Figure 6:
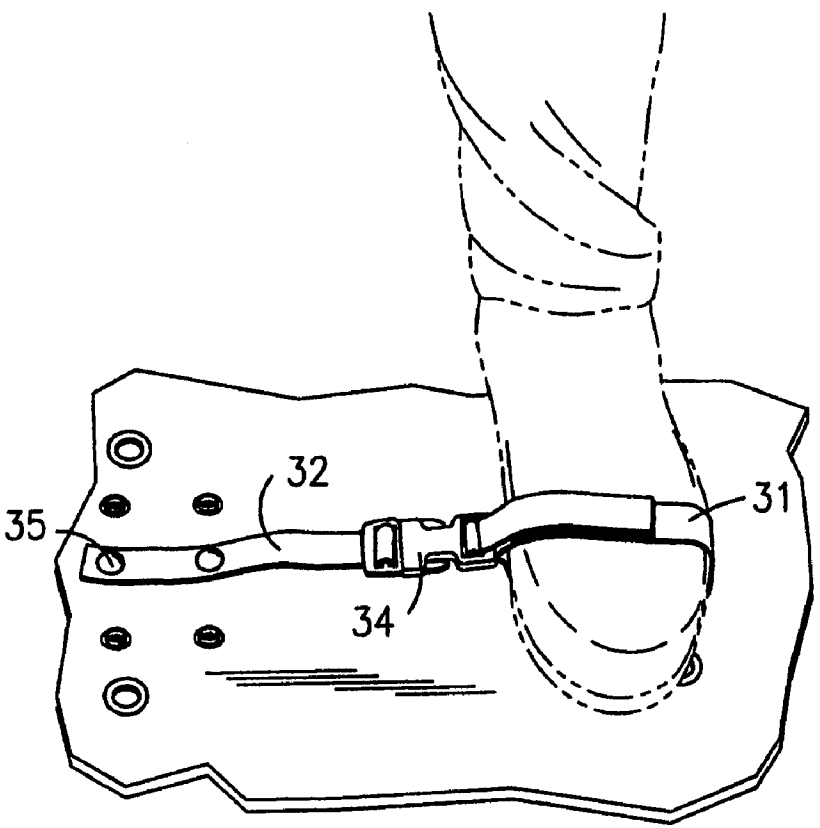
FIG. 6 is a perspective view from above, looking down (at about 45°) at the invention of FIG. 4 with a foot encaptured (broken lines, for illustrative purposes only, without forming any part of the claimed design); on the inner side of the batter's foot, the stirrup is looping up through an aperture in the buckle, and with the tether anchored to the substratum so that the batter's foot may stride forward essentially free of substantial destabilizing hindrance to the toes.
Figure 5:
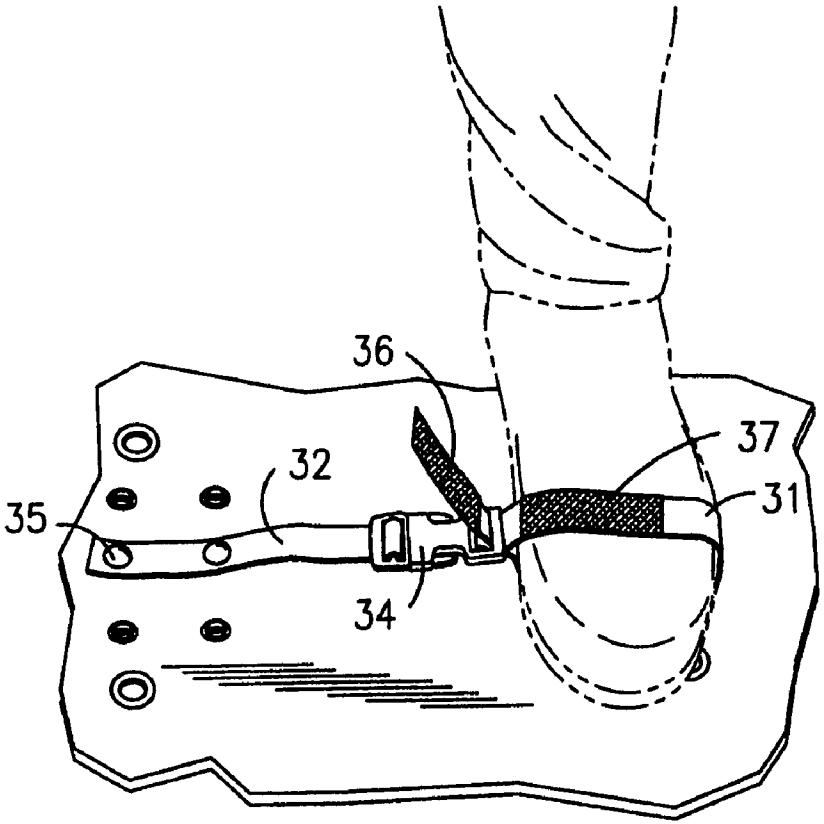
FIG. 5 is a perspective view from above and the side, looking down (at about 45°) at the invention of FIG. 4 with a foot encaptured (broken lines, for illustrative purposes only, without forming any part of the claimed design).

The claims of this invention are to be read to include any legally equivalent device or method. Before the present invention is described in detail, it is to be understood that the invention is not limited to the particular configurations, process steps and materials disclosed herein. It is also to be understood that the terminology used herein is not intended to be limiting, since the scope of the present invention will be limited only by the claims and equivalents thereof. The invention is not limited by construction materials, to the extent that such materials satisfy the structural or functional requirements; for example, any materials may be used to make the tethering means so long as the materials fulfill the requirements that said materials provide the desired or necessary amount of biasing. For the sake of simplicity and to give the claims of this patent application the broadest interpretation and construction possible, the following definitions will apply to this application:

1. The phrase "substantial destabilizing hindrance" or derivative thereof means any permanent or temporary obstacle or opposing force capable of destabilizing the batter enough to cause the batter to trip or stumble, especially forward and/or inward toward the plate and any oncoming pitch.
2. The phrase "ambulatory appendage" means the leg and foot, especially the lowermost portion of the leg (below the knee) to the "arch" and "ball" portions of the foot.
3. The word "foot" means the batter's foot and any covering such as a shoe, sock, brace or bandage.
4. The word "stirrup" or derivative thereof means any member or assembly capable of capturing a batter's foot, at least during the batter's hitting motion.
5. The word "tether" or derivative thereof means any member or assembly capable of, when cooperating with a stirrup, providing a batter's foot with a predetermined amount of biasing relative to substratum, sufficient to discourage the pointing of the toes of the batter's leading foot (and/or its improperly lengthy striding) directly toward the oncoming pitched ball.
6. The word "distal" or derivative thereof means away from the central body or point of attachment thereto.
7. The word "proximal" or derivative thereof means near the central part of the body, or point of attachment.

Likewise, when the plural form is used, it may be taken to include the singular form, and vice versa. Similarly, the conjunctive "and" used in the written description may also be taken to include the disjunctive "or" in the written description, and vice versa, for the sake of simplicity and whenever necessary to give the claims of this patent application the broadest interpretation and construction possible.

In most general form, the invention disclosed herein includes an apparatus for modifying the stride of a baseball batter's swing motion, comprising a means of capturing a lower portion of a baseball batter's foremost ambulatory appendage and a means of elastomerically tethering the capturing means to substratum. In this manner, the batter's leading toes are allowed to stride in any direction essentially free of substantial distal destabilizing hindrance, especially forward toward the pitcher's mound. In one version of the invention, said capture means comprises a stirrup sized to circumnavigate at least a lower portion of a baseball batter's foremost ambulatory appendage. More particularly, said stirrup is long enough to capture the batter's lowermost leg, the ankle, the arch portion of the batter's foot or the ball of the batter's foot, and combinations thereof. It is preferred that said stirrup is long enough to capture at least the arch portion of a batter's foot.

The stirrup may include quick release features, to facilitate easy use during practice. In one embodiment of the invention, the stirrup further comprises a first terminus and a second portion, said first terminus including one matable part of a fastening assembly selected from the group consisting of a hook-and-loop fastening system, an interlocking quick-release buckle system, at least one snap system, a standard buckling system, and combinations thereof (One of the important characteristics common to each of said members in said group, supporting the inclusion of each member in said particular group, is that it will facilitate ready fastening and unfastening, whether it be for the purpose of tethering or anchoring or whatever.) The second portion of the stirrup further includes a cooperating mate-part of said fastening assembly, capable of ready capturing and uncapturing. More particularly, said first terminus comprises an aperture sized to accept said stirrup inserted therethrough. In this version, said second terminal portion comprises a second terminus including one matable part of a hook-and-loop fastening system, and further includes an intermediate portion including the cooperating mate-part of said hook-and-loop fastening system; said second terminus is insertable through said aperture, doubling back against said intermediate portion for cooperative mating of said hook-and-loop fastening system.

In another version of the invention, said stirrup further comprises a means of releasably anchoring to said tethering means, selected from the group consisting of a hook-and-loop fastening system, an interlocking quick-release buckle system, at least one snap system, a standard buckling system, and combinations thereof. Preferably, said releasable anchoring means comprises one matable part of an interlocking quick-release buckle system attached to said first terminus of said stirrup, and the other matable part of an interlocking quick-release buckle system attached to said and end of said tethering means. Such anchoring may occur by way of one or more matable snaps that separate when opposing force (such as the biasing constraint of the elastomeric tethering) becomes sufficient to constitute substantial destabilizing hindrance, and thereby releases the batter from the constraint of the elastomeric tether.

Another version of the invention may include auxiliary untethering means, whereby the end of the tether nearest the substratum may be detached from the substratum. In this embodiment, said auxiliary untethering means comprises a fastening assembly selected from the group consisting of a hook-and-loop fastening system, an interlocking quick-release buckle system, at least one snap system, a standard buckling system, and combinations thereof. Preferably, said auxiliary untethering means comprises at least one matable snap near a second tether terminal end, and a cooperating matable snap anchored to said substratum. Such anchoring may occur by way of one or more matable snaps that separate when opposing force (such as the biasing constraint of the elastomeric tethering) becomes sufficient to constitute substantial destabilizing hindrance, and thereby releases the batter from the constraint of the elastomeric tether. More preferably, said auxiliary untethering means comprises a plurality of matable snaps aligned along said second tether terminal end, and cooperating matable snaps anchored to said substratum. Said substratum may include a plurality of alignments of cooperating matable snaps.

Although almost any substratum may be used so long as it is capable of preventing easy movement of the tethering means, the preferred version includes substratum made of carpet or similar material. The substratum may be of any length and width capable of fulfilling its anchoring functions; preferably, it may be the approximate size and shape of a batter's box. The substratum may further include at least one aperture or grommet (39) along a foremost margin, capable of accepting impalement by a means for staking said substratum to the underlying surface. More particularly, there may be a plurality of said marginal grommets, spaced to assure the desired level of staking of said substratum.

This invention may include a plurality of separate capture means, one worn by one batter and another worn by another batter "on deck". This will save much valuable time during practice, allowing one batter to prepare for his or her turn to bat while waiting for the current batter to complete batting. Each separate capture means may include tethering means having the length, width, thickness and elasticity suitable for optimal modification of the batting swing motion of the particular wearer.

Besides the various embodiments of the apparatus described hereinabove, the invention disclosed herein also includes a method of using the apparatus. Such a method of modifying the stride of a baseball batter's swing motion comprises the steps of capturing a lower portion of a first baseball batter's foremost ambulatory appendage batter's with a device claimed hereinabove, and utilizing same during batting practice. The method may also include the multi-batter scenario, further comprising the steps of untethering said capture means of said first batter, then tethering a second batter whose lower portion of the foremost ambulatory appendage has been captured by a separate capture means.

Those skilled in the art who have the benefit of this disclosure will appreciate that it may be used as the creative basis for designing devices or methods similar to those disclosed herein, or to design improvements to the invention disclosed herein; such new or improved creations should be recognized as dependant upon the invention disclosed herein, to the extent of such reliance upon this disclosure.

We claim:

1. An apparatus for modifying the stride of a baseball batter's swing motion, comprising:

a stirrup sized for capturing a lower portion of a baseball batter's foremost ambulatory appendage;

an elastomeric tethering strap comprising an end attached to said stirrup and an anchoring end connected to a substratum by means for releasably anchoring said tethering strap to said substratum affixed atop the ground surface, said strap sized for elastomerically tethering the baseball batter's captured appendage to said substratum, said elastomericity including biasing favoring the return of said strap to its original shorter length and providing elastomeric constraint essentially equally in all directions during elastomeric lengthening of said strap, said elastomeric constraint being insufficient to prevent the batter's foot from leaving said substratum;

said releasable anchoring means releasing when said elastomeric constraint constitutes substantial destabilizing hindrance.

2. An apparatus described in claim 1 hereinabove, said means for releasably anchoring said tethering strap to said substratum selected from the group consisting of matable halves of a snap and a hook and loop fastening system, and combinations thereof, one half attached to said substratum and the other half attached to said tethering strap anchoring end.

3. An apparatus described in claim 2 hereinabove, said means for releasably anchoring said tethering strap to said substratum comprising one matable half of a snap attached to said substratum and the other matable half of said snap attached to said tethering strap anchoring end.

4. An apparatus described in claim 1 hereinabove, said stirrup comprising a stirrup strap sized to circumnavigate at least a lower portion of a baseball batter's foremost ambulatory appendage.

5. An apparatus described in claim 4 hereinabove, wherein said stirrup strap is long enough to capture the arch portion of the batter's foot.

6. An apparatus described in claim 4 hereinabove, wherein said stirrup strap is long enough to capture the batter's lowermost leg.

7. An apparatus described in claim 4 hereinabove, said stirrup strap comprising:

a first terminus and a second portion, said first terminus including one matable part of a fastening assembly selected from the group consisting of a hook-and-loop fastening system, an interlocking quick-release buckle system, at least one snap system, a standard buckling system, and combinations thereof;

said second portion comprising a cooperating mate-part of said fastening assembly, capable of ready capturing and uncapturing.

8. An apparatus described in claim 7 hereinabove, wherein:

said first terminus comprises an aperture sized to accept said stirrup strap inserted therethrough;

said stirrup strap further comprising a second terminus including one matable part of a hook-and-loop fastening system, and further comprising an intermediate portion including the cooperating mate-part of said hook-and-loop fastening system, said second terminus insertable through said aperture and doubling back against said intermediate portion for cooperative mating of said hook-and-loop fastening system.

9. An apparatus described in claim 4 hereinabove, wherein said tethering strap end attachment to said stirrup strap further comprising a second anchoring means for releasably attaching said tethering strap to said stirrup strap, selected from the group consisting of a hook-and-loop fastening system, an interlocking quick-release buckle system, at least one snap system, a standard buckling system, and combinations thereof.

10. An apparatus described in claim 9 hereinabove, wherein said second anchoring means comprises one matable part of an interlocking quick-release buckle system attached to said first terminus of said stirrup, and the other matable part of an interlocking quick-release buckle system attached to said and end of said tethering strap.

11. An apparatus described in claim 1 hereinabove, wherein said substratum comprises carpet.

12. An apparatus described in claim 11 hereinabove, further comprising at least one grommet along a foremost margin of said substratum, capable of accepting impalement by a means for staking said substratum to the underlying surface.

13. An apparatus described in claim 11 hereinabove, further comprising a plurality of marginal grommets, spaced to assure the desired level of staking of said substratum.

14. An apparatus described in claim 1 hereinabove, comprising a plurality of separate stirrups, one worn by one batter while tethered to said substratum and another worn by a prospective batter off of said substratum.

15. An apparatus described in claim 14 hereinabove, wherein each separate stirrup comprises a separate tethering strap having the length, width, thickness and elasticity suitable for optimal modification of the batting swing motion of the particular wearer.

16. An apparatus for modifying the stride of a baseball batter's swing motion, comprising:

a stirrup strap sized for capturing the arch portion of a baseball batter's foremost foot while standing on a substratum affixed atop the ground surface, comprising a first terminus and a second portion, said first terminus including one matable part of a hook-and-loop fastening system and said second portion comprising a cooperating mate-part of said fastening assembly, said first terminus further comprising an aperture sized to accept said stirrup strap inserted therethrough and doubling back against said second for cooperative mating of said hook-and-loop fastening system, said stirrup strap further comprising a second terminus including one matable part of a quick release buckle;

an elastomeric tethering strap comprising an end snapped to said substratum, and a second end comprising the other matable part of said quick release buckle.

* * * * *